US007652645B2

(12) United States Patent
Park et al.

(10) Patent No.: US 7,652,645 B2
(45) Date of Patent: Jan. 26, 2010

(54) LIGHT EMITTING DISPLAY

(75) Inventors: Sung Cheon Park, Suwon (KR); Ki Myeong Eom, Suwon (KR); Young Jong Park, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 749 days.

(21) Appl. No.: 11/191,472

(22) Filed: Jul. 27, 2005

(65) Prior Publication Data

US 2006/0022912 A1 Feb. 2, 2006

(30) Foreign Application Priority Data

Jul. 27, 2004 (KR) ..... 10-2004-0058904

(51) Int. Cl.
*G09G 3/30* (2006.01)

(52) U.S. Cl. ..... 345/76; 345/100; 345/101; 345/82

(58) Field of Classification Search ..... 345/100–101, 345/82, 76

See application file for complete search history.

(56) References Cited

U.S. PATENT DOCUMENTS 6,670,771 B2 12/2003 Shin et al.
6,914,956 B2 * 7/2005 Kawasaki et al. ..... 377/68
7,218,296 B2 * 5/2007 Wang et al. ..... 345/82
2007/0097063 A1 * 5/2007 Kida et al. ..... 345/100

FOREIGN PATENT DOCUMENTS

JP 2004-29755 1/2004
KR 10-1997-022418 8/1998
WO WO 03/091977 A1 11/2003

OTHER PUBLICATIONS

Patent Abstracts of Japan, Publication No. 2004-029755; Publication Date Jan. 29, 2004; in the name of Takahara.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A light emitting display including a pixel area having a plurality of pixels, a scan driver for outputting a scan signal for selecting a predetermined pixel among the plurality of pixels of the pixel area, and an emission control signal for allowing a current to flow in the selected pixels. The scan driver includes: a signal generator adapted to generate the scan signal and the emission control signal; a first buffer adapted to transmit the scan signal to the pixel area; and a second buffer adapted to transmit the emission control signal to the pixel area. In the scan driver, the second buffer is smaller than the first buffer. The size of the second buffer is decreased to decrease the size of the scan driver, and/or to decrease the size of the predetermined pixel to get a high definition.

15 Claims, 8 Drawing Sheets

LIGHT EMITTING DISPLAY

CROSS-REFERENCE TO RELATED APPLICATIONS

This application claims priority to and the benefit of Korean Patent Application No. 10-2004-0058904, filed on Jul. 27, 2004, in the Korean Intellectual Property Office, the entire disclosure of which is incorporated herein by reference.

BACKGROUND

1. Field of the Invention

The present invention relates to a light emitting display and a scan driver, and more particularly, to a light emitting display and a scan driver for outputting a scan signal and an emission control signal, in which the scan driver provided in the light emitting display includes a first buffer for outputting the emission control signal, the first buffer being smaller than a second buffer for outputting the scan signal, thereby decreasing the size of the scan driver.

2. Discussion of Related Art

A thin and lightweight flat panel display has been widely used for monitors of various information terminals such as personal computers, mobile phones, personal digital assistants, etc. A flat panel display can be classified into a passive matrix type flat panel display and an active matrix type flat panel display according to methods of driving a pixel of the display. In the flat panel display, a displaying area includes a plurality of pixels arranged in a matrix format on a substrate. Each of the pixels is connected with, and selectively receives data signal from, a scan line and a data line to display an image. When resolution, contrast, operation time, and so on are taken into consideration, the active matrix type flat panel display capable of selectively switching the pixels by a unit pixel has been mostly used.

A flat panel display can also be a liquid crystal display (LCD) using a liquid crystal panel, an organic light emitting display using an organic light emitting device (OLED), a plasma display panel (PDP) using a plasma panel, etc.

Particularly, the OLED can emit light by itself on the basis of recombination of an electron and a hole and has a fast response time that is more similar to a cathode ray tube (CRT) than to a light emitting display requiring a separate light source, such as the LCD. Thus, the OLED has become very important.

FIG. 1 is a plan view of a configuration of a conventional light emitting display.

Referring to FIG. 1, the conventional light emitting display includes a pixel area 10 having N×M pixels 11 and for displaying an image corresponding to light emissions of the pixels 11; a scan driver 20 for supplying scan signals and emission control signals to the pixel area 10; and a data driver 30 for supplying data signals to the pixel area 10.

The pixel area 10 includes a plurality of scan lines S1, S2, S3, . . . , SN−1, SN (where 'N' is a natural number); a plurality of data lines D1, D2, D3, . . . , DM−1, DM (where 'M' is a natural number) arranged perpendicularly to the plurality of scan lines S1, S2, S3, . . . , SN−1, SN; and the N×M pixels 11 formed adjacent to regions where the plurality of scan lines S1, S2, S3, . . . , SN−1, SN and the plurality of data lines D1, D2, D3, . . . , DM−1, DM are crossed with each other.

Further, the pixel area 10 receives the scan signals through the plurality of scan lines S1, S2, S3, . . . , SN−1, SN, and allows the pixels 11 disposed on a predetermined row corresponding to a received scan signal to receive the data signals.

The scan driver 20 supplies the scan signals and the emission control signals to the pixel area 10 in sequence through the plurality of scan lines S1, S2, S3, . . . , SN−1, SN and a plurality of emission control lines (not shown), so that all rows of the pixel area 10 are sequentially selected corresponding to one frame and sequentially controlled by the emission control signals.

The data driver 30 is connected to the plurality of data lines D1, D2, D3, . . . , DM−1, DM, and supplies the data signals to the pixel area 10 through the plurality of data lines D1, D2, D3, . . . , DM−1, DM, so that a data signal is supplied to each pixel 11 selected by a scan signal, thereby displaying an image corresponding to the data signal on the pixel area 10.

FIG. 2 is a block diagram of a scan driver provided in a conventional light emitting display. Referring to FIG. 2, the scan driver 20 includes a shift register 21 for outputting a plurality of signals in response to an input signal; an operator 22 for creating scan signals and emission control signals based on the signals outputted by the shift register 21; and a buffer unit 23 for receiving the signals outputted by the operator 22 and for outputting them as buffered signals.

The operator 22 receives the plurality of signals from the shift register 21 and performs an operation to output the plurality of scan signals s1, s2, s3, . . . , sn−1, sn (where 'n' is a natural number), and the plurality of emission control signals (not shown). Each of the scan signals s1, s2, s3, . . . , sn−1, sn is transmitted to a switching transistor (not shown) of a pixel, thereby allowing a data signal to be transmitted to the pixel. Each of the emission control signals is transmitted to a gate electrode of an emission control transistor (not shown), thereby allowing a driving transistor (not shown) to switch a driving current that corresponds to the data signal. The driving current is supplied to an OLED.

The buffer unit 23 increases the intensity of the scan signals s1, s2, s3, . . . , sn−1, sn and the emission control signals created by the operator 22, and outputs them to the pixel area 10. When the scan signals are directly transmitted from the operator 22 to the pixel area 10 without passing through the buffer unit 23, the scan signals, which are relatively distant from the operator 22, are not smoothly transmitted to the pixels 11. Therefore, the intensity of each of the scan signals and the emission control signals is increased by the buffer unit 23 connected to the operator 22, and then transmitted to the pixel area 10.

In the above described light emitting display, the size of the scan driver 20 and the interval of the scan lines are determined according to the sizes of the buffer unit 23. That is, in a case where the size of the buffer unit 23 becomes large, the size of the scan driver 20 is enlarged, and the intervals of the scan lines are widened. Because of this, as the size of the scan driver 20 is increased, power consumption is increased. Accordingly, as the intervals of the scan lines are widened, each of the pixels 11 is enlarged.

Particularly, when the light emitting display is a large-sized screen, the size of the buffer unit 23 is increased, so that the intervals of the scan lines are widened, thereby enlarging the size of each of the pixels 11. In this case, it is difficult to get a high definition. Further, the power consumed in the buffer unit 23 is increased, so that the light emitting display consumes relatively more power in displaying an image.

SUMMARY OF THE INVENTION

An embodiment of the present invention provides a light emitting display and a scan driver, in which the size of a buffer is decreased, thereby decreasing the size of a scan driver to reduce power consumption in the light emitting display, and decreasing the size of a pixel to provide a high definition.

One embodiment of the present invention provides a light emitting display including a pixel area having a plurality of pixels, a scan driver for outputting a scan signal for selecting a predetermined pixel among the plurality of pixels of the pixel area, and an emission control signal for controlling a current to flow in the predetermined pixels, the scan driver including: a signal generator adapted to generate the scan signal and the emission control signal; a first buffer adapted to transmit the scan signal to the pixel area; and a second buffer adapted to transmit the emission control signal to the pixel area. In this embodiment, the second buffer is smaller than the first buffer.

One embodiment of the present invention provides a light emitting display including: a pixel area having a plurality of pixels; a scan driver having a signal generator adapted to generate a scan signal and an emission control signal, a first buffer adapted to transmit the scan signal to the pixel area, and a second buffer adapted to transmit the emission control signal to the pixel area; and a data driver adapted to generate a data signal to the pixel area. In this embodiment, the first buffer has a first response time and the second buffer has a second response time. The first response time is faster than the second response time.

One embodiment of the present invention provides a scan driver including: a signal generator having a shift register adapted to shift an input signal and output the shifted signal to a plurality of output terminals, and an operator adapted to perform an operation on the plurality of signals outputted from the shift register through the plurality of output terminals and output a scan signal for selecting a predetermined pixel and an emission control signal for allowing a current to flow in the predetermined pixel; a first buffer adapted to transmit the scan signal to the predetermined pixel; and a second buffer adapted to transmit the emission control signal to the predetermined pixel. In this embodiment, the second buffer is smaller than the first buffer.

BRIEF DESCRIPTION OF THE DRAWINGS

The accompanying drawings, together with the specification, illustrate exemplary embodiments of the present invention, and, together with the description, serve to explain the principles of the invention.

DETAILED DESCRIPTION

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

Figure 3:
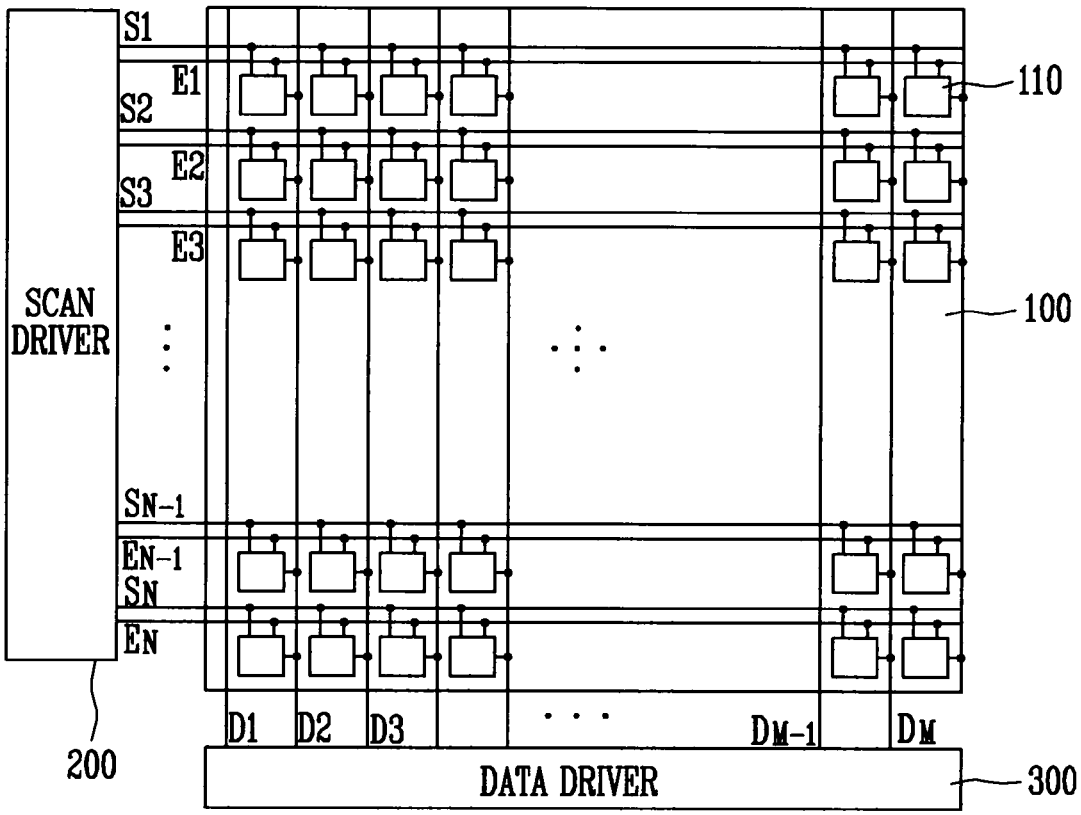
FIG. 3 is a plan view of a configuration of a light emitting display according to an embodiment of the present invention.

FIG. 3 is a plan view of a configuration of a light emitting display according to an embodiment of the present invention. As shown therein, the light emitting display according to the embodiment of the present invention includes a pixel area 100 having N×M pixels 110 and for displaying an image corresponding to light emissions of the pixels 110; a scan driver 200 for supplying scan signals and emission control signals to the pixel area 100; and a data driver 300 for supplying data signals to the pixel area 100.

The pixel area 100 includes a plurality of scan lines S1, S2, S3, . . . , SN−1, SN (where 'N' is a natural number); a plurality of emission control lines E1, E2, E3, . . . , EN−1, EN in parallel with the plurality of scan lines S1, S2, S3, . . . , SN−1, SN respectively; a plurality of data lines D1, D2, D3, . . . , DM−1, DM (where 'M' is a natural number) arranged perpendicularly to both the plurality of scan lines S1, S2, S3, . . . , SN−1, SN and the plurality of emission control lines E1, E2, E3, . . . , EN−1, EN; and the N×M pixels 110 formed adjacent to regions where the plurality of scan and emission control lines S1, S2, S3, . . . , SN−1, SN, E1, E2, E3, . . . , EN−1, EN are crossed with the plurality of data lines D1, D2, D3, . . . , DM−1, DM.

Further, the pixel area 100 receives the scan signals through the plurality of scan lines S1, S2, S3, . . . , SN−1, SN, and the emission control signals through the plurality of emission control lines E1, E2, E3, . . . , EN−1, EN, thereby allowing the pixels 110 disposed on a predetermined row corresponding to a received scan signal and a received emission control signal to receive the data signals.

Each pixel 110 includes a switching device formed of a thin film transistor (TFT). The switching device controls the received scan signal and the data signal, thereby allowing the pixel 110 to emit light.

The scan driver 200 supplies the scan signals and the emission control signals to the pixel area 100 in sequence through the plurality of scan lines S1, S2, S3, . . . , SN−1, SN and the plurality of emission control lines E1, E2, E3, . . . , EN−1, EN, so that all rows of the pixel area 100 are sequentially selected corresponding to one frame and sequentially controlled by the scan and emission control signals.

Figure 8:
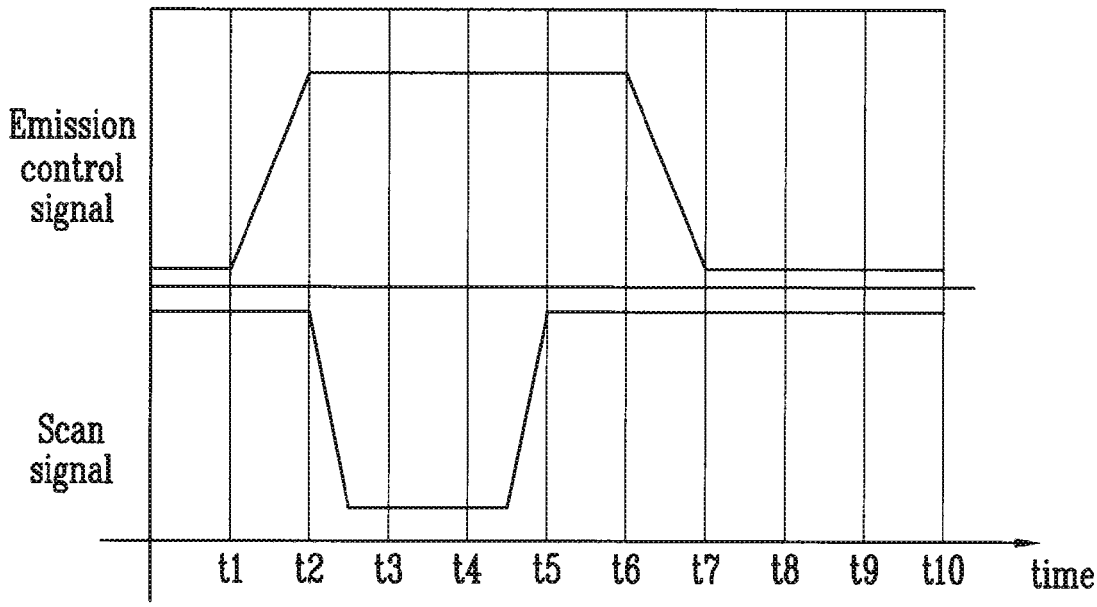
FIG. 8 is a drawing illustrating signals generated by a buffer unit provided in a scan driver according to an embodiment of the present invention.

According to an embodiment of the present invention, a scan signal has a rise time and a fall time faster than those of a corresponding emission control signal, for example, as shown in FIG. 8. However, the present invention is not limited to the exemplary signals illustrated in FIG. 8.

The data driver 300 is connected to the plurality of data lines D1, D2, D3, . . . , DM−1, DM, and supplies the data signals to the pixel area 100 through the plurality of data lines D1, D2, D3, . . . , DM−1, DM, so that a data signal is supplied to each pixel 110 selected by a scan signal, thereby displaying an image corresponding to the data signal on the pixel area 100.

Figure 4:
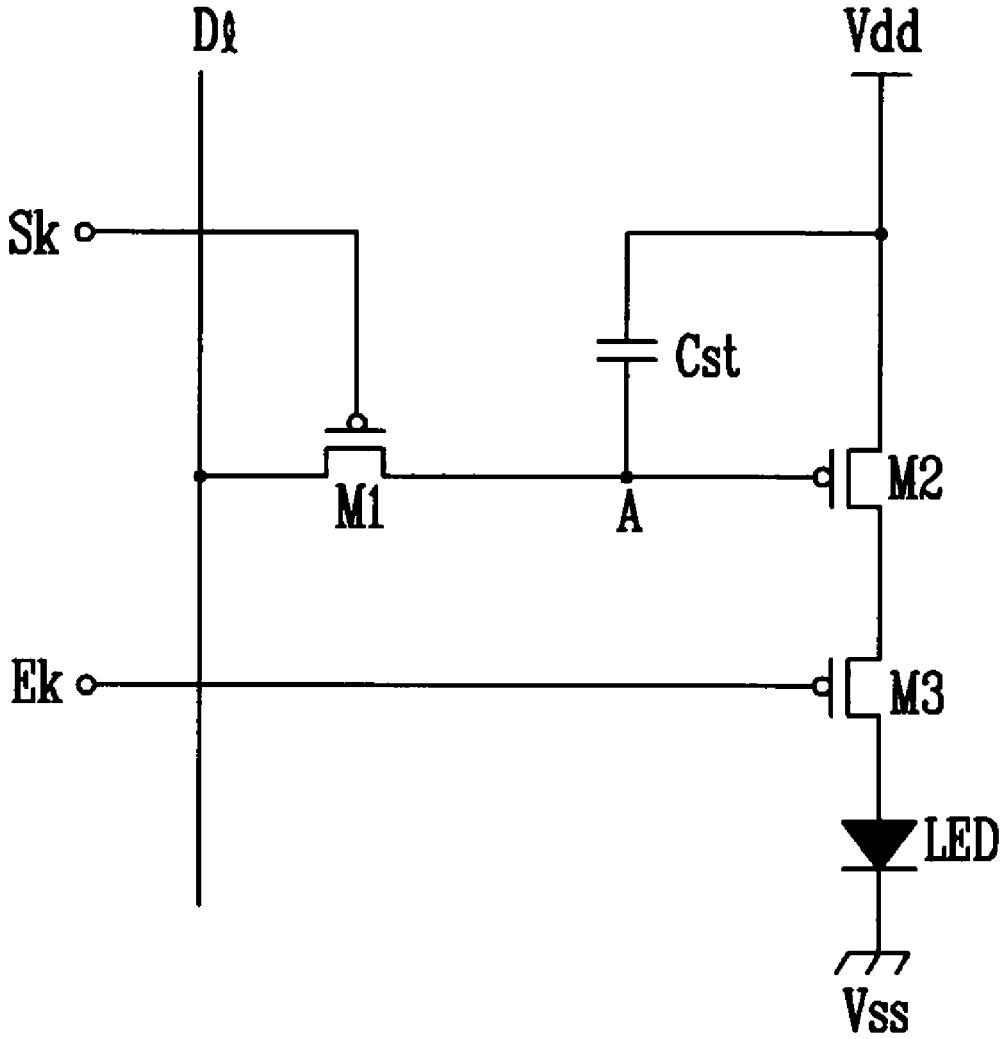
FIG. 4 is a circuitry diagram of a pixel provided in a light emitting display according to an embodiment of the present invention.

FIG. 4 is a circuit diagram of a pixel provided in a light emitting display according to an embodiment of the present invention. As shown therein, the pixel includes a light emitting device LED and a pixel driving circuitry. The pixel driving circuitry includes a switching transistor M1, a driving transistor M2, an emission control transistor M3, and a storage capacitor Cst.

Each of the switching transistor M1, the driving transistor M2, and the emission control transistor M3 includes a gate, a source and a drain. The storage capacitor Cst includes a first electrode and a second electrode.

The switching transistor M1 includes the source connected to a data line D1, the drain connected to a first node A, and the gate connected to a scan line Sk. In the switching transistor M1, a data signal is transmitted to the first node A in response to a scan signal transmitted to the gate.

The driving transistor M2 includes the source connected to a power line Vdd, the drain connected to the source of the emission control transistor M3, and the gate connected to the first node A. Further, the first node A is connected to the drain of the switching transistor M1. Here, the driving transistor M2 supplies a current corresponding to the data signal to the light emitting device LED.

The emission control transistor M3 includes the source connected to the drain of the driving transistor M2, the drain connected to an anode electrode of the light emitting device LED, and the gate connected to an emission control line Ek to correspond to an emission control signal. Thus, the emission control transistor M3 switches current flowing from the driving transistor M2 to the light emitting device LED on the basis of the emission control signal, thereby controlling the light emitting device LED. Here, k and l are natural numbers.

The storage capacitor Cst includes the first electrode connected to the power line Vdd, and the second electrode connected to the first node A. Further, the storage capacitor Cst is charged with an electric charge corresponding to the data signal, and a signal corresponding to the data signal is applied to the gate of the driving transistor M2 by the electric charge charged in the storage capacitor Cst during one frame, thereby keeping the driving transistor M2 operating during one frame.

Figure 5:
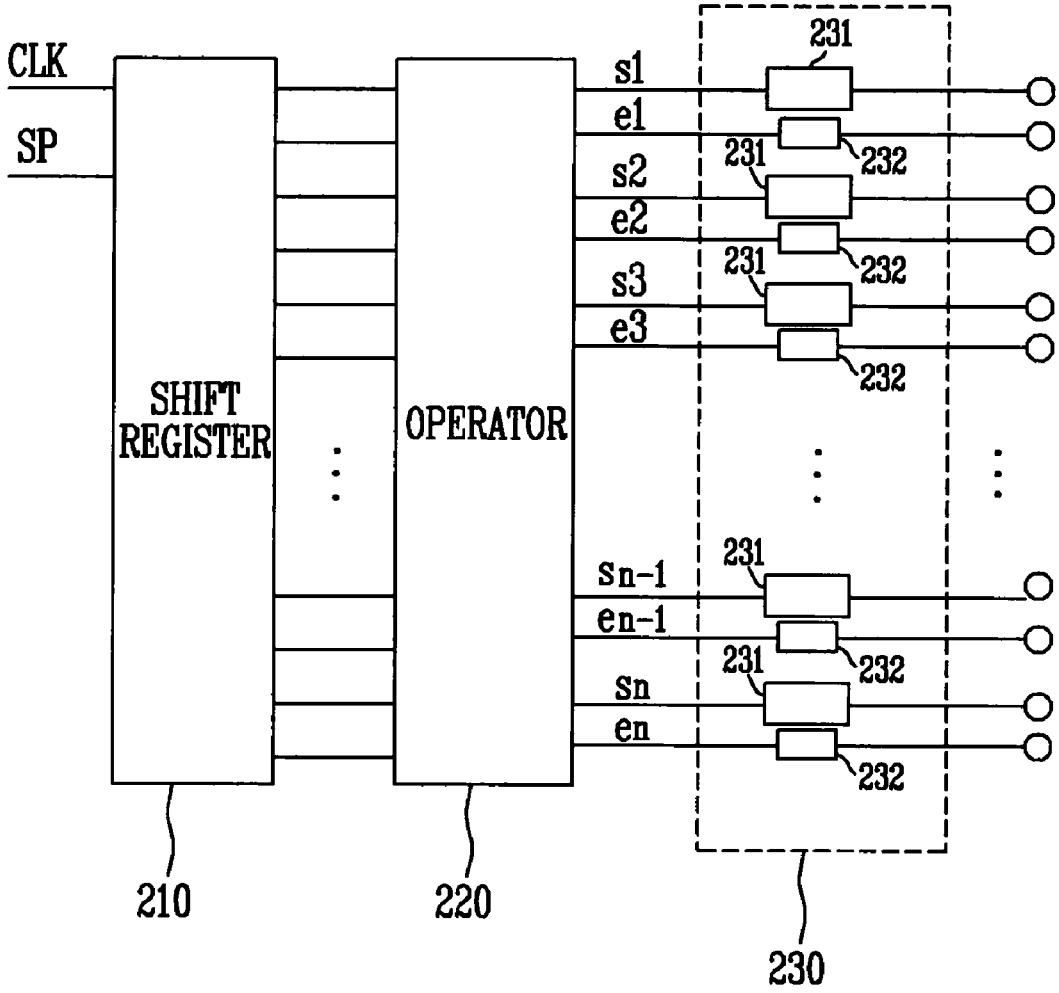
FIG. 5 is a block diagram of a scan driver provided in a light emitting display according to an embodiment of the present invention.

FIG. 5 is a block diagram of a scan driver provided in a light emitting display according to an embodiment of the present invention. As shown therein, the scan driver 200 includes a shift register 210 for outputting a plurality of signals in response to an input signal; an operator 220 for creating scan signals and emission control signals based on signals outputted by the shift register 210; and a buffer unit 230 for receiving the signals outputted by the operator 220 and for outputting them as buffered signals.

The shift register 210 receives a clock signal CLK and a start pulse SP, and outputs the plurality of signals.

The operator 220 receives the plurality of signals from the shift register 210 and performs an operation to output the plurality of scan signals s1, s2, s3, . . . , sn−1, sn (where 'n' is a natural number), and the plurality of emission control signals e1, e2, e3, . . . , en−1, en. Each of the scan signals s1, s2, s3, . . . , sn−1, sn is transmitted to a switching transistor (e.g., the switching transistor M1) of each pixel (e.g., the pixel 110), thereby allowing a data signal to be transmitted to the pixel. Each of the emission control signals e1, e2, e3, . . . , en−1, en is transmitted to the gate of an emission control transistor (e.g., the emission control transistor M3), thereby allowing a driving transistor (e.g., the driving transistor M2) to switch a driving current that corresponds to the data signal. The driving current is supplied to a light emitting device (e.g., the light emitting device LED).

The buffer unit 230 increases the intensity of the scan signals s1, s2, s3, . . . , sn−1, sn and the emission control signals e1, e2, e3, . . . , en−1, en created by the operator 220, and outputs them to a pixel area (e.g., the pixel area 100). When the scan signals are directly transmitted from the operator 220 to the pixel area (e.g., the pixel area 100) without passing through the buffer unit 230, the scan signals, which are relatively distant from the operator 220, are not smoothly transmitted to the pixels 110. Therefore, the scan signals s1, s2, s3, . . . , sn−1, sn and the emission control signals e1, e2, e3, . . . , en−1, en are strengthened by the buffer unit 230 connected to the operator 220, and then transmitted to the pixel area 100.

Further, the buffer unit 230 includes first buffering parts (or buffers) 231 respectively connected to output terminals of the operator 220 for outputting the scan signals s1, s2, s3, . . . , sn−1, sn; and second buffering parts (or buffers) 232 respectively connected to output terminals of the operator 220 for outputting the emission control signals e1, e2, e3, . . . , en−1, en. Here, the scan signals s1, s2, s3, . . . , sn−1, sn are employed in transmitting the data signals to the pixel area 100, so that the scan signals s1, s2, s3, . . . , sn−1, sn should have a fast rise time and a fast fall time to correctly transmit the data signals. However, the emission control signals e1, e2, e3, . . . , en−1, en are employed in supplying the current to the light emitting device (e.g., the light emitting device LED), so that having a fast rise time and a fast fall time is not as important for the emission control signals e1, e2, e3, . . . , en−1, en as compared to the case of the scan signals s1, s2, s3, . . . , sn−1, sn.

Figure 1:
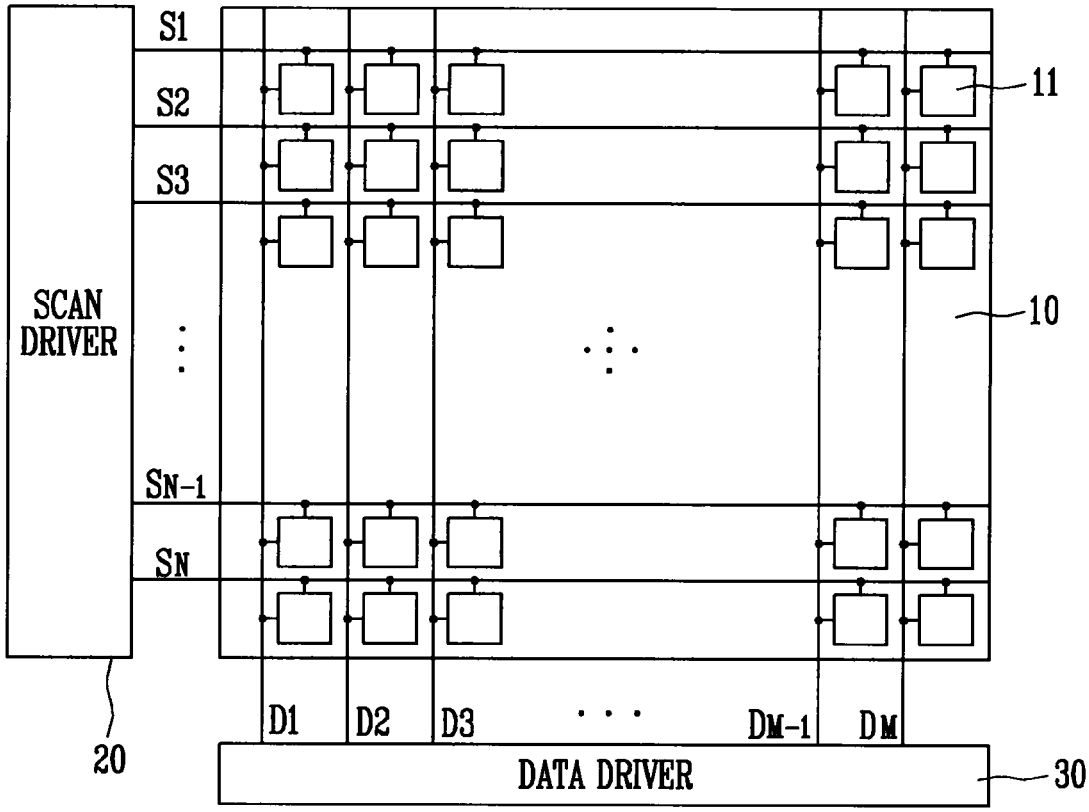
FIG. 1 (PRIOR ART)
FIG. 1 is a plan view of a configuration of a conventional light emitting display.
Figure 2:
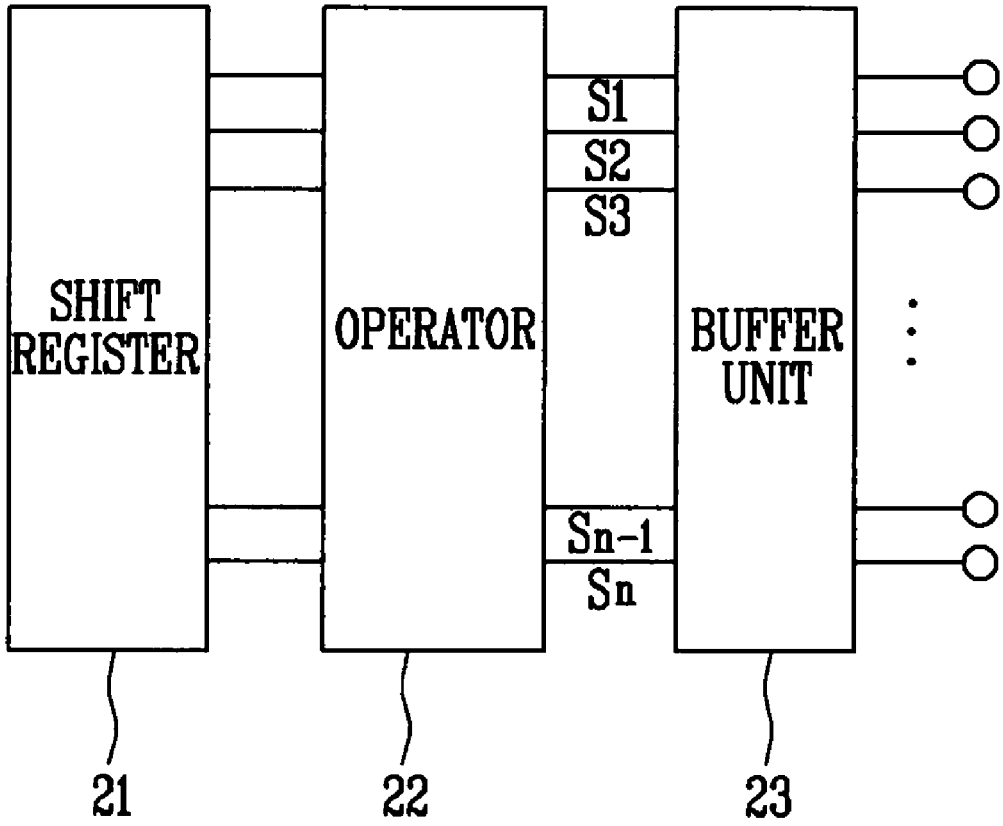
FIG. 2 (PRIOR ART)
FIG. 2 is a block diagram of a scan driver provided in a conventional light emitting display.

For example, in a case where a pixel area (e.g., the pixel area 10 of FIG. 1) has a size of a quarter video graphic array (QVGA), (320×240RGB pixels) and is driven at a frequency of 60 Hz, and the time it takes for keeping a scan signal sk applied to one scan line Sk is approximately 50 μs, the scan signal sk has the rise time and the fall time of 2 μs and 2 μs, respectively. In this case, a corresponding data signal is not correctly transmitted during approximately 8% of the keeping time for the scan signal sk because the scan signal sk has a total rise and fall time of 4 μs.

Likewise, if the rise time and the fall time are too slow, the scan signal sk and a following scan signal sk+1 are likely to overlap with each other, so that there arises a problem in that a data signal corresponding to the data line Dl is applied to the data line Dl+1. Because of this, the scan signal sk should have a fast rise time and a fast fall time.

However, an emission control signal ek is applied for a relatively long time of 16.7 ms, so that the whole period is not much affected by the rise time and the fall time having a relatively fast time of 2 μs, respectively. Further, even if the emission control signal ek and a following emission control signal ek+1 are overlapped with each other, an image may still be properly displayed.

Therefore, the size of a first buffer 231 should be designed to make the scan signals s1, s2, s3, . . . , sn−1, sn have a fast rise time and a fast fall time in consideration of a pixel load. On the other hand, the size of a second buffer 232 should be designed to be smaller than that of the first buffer 232 because a fast rise time and a fast fall time are not as important for the emission control signals e1, e2, e3, . . . , en−1, en.

Thus, as compared with the size of a scan driver having a first buffer and a second buffer of the same size, the size of a scan driver (e.g., the driver 200) of an embodiment of the present invention having a second buffer (e.g., the second buffer 232), which is smaller than a first buffer (e.g., the first buffer 231), is decreased. Further, an interval distance between the scan line and the emission control line (and/or between two scan lines or two emission lines) can be decreased, thereby reducing the size of a pixel (e.g., the pixel 110). Also, the power consumed by a scan driver (e.g., the scan driver 200) can be reduced.

Figure 6:
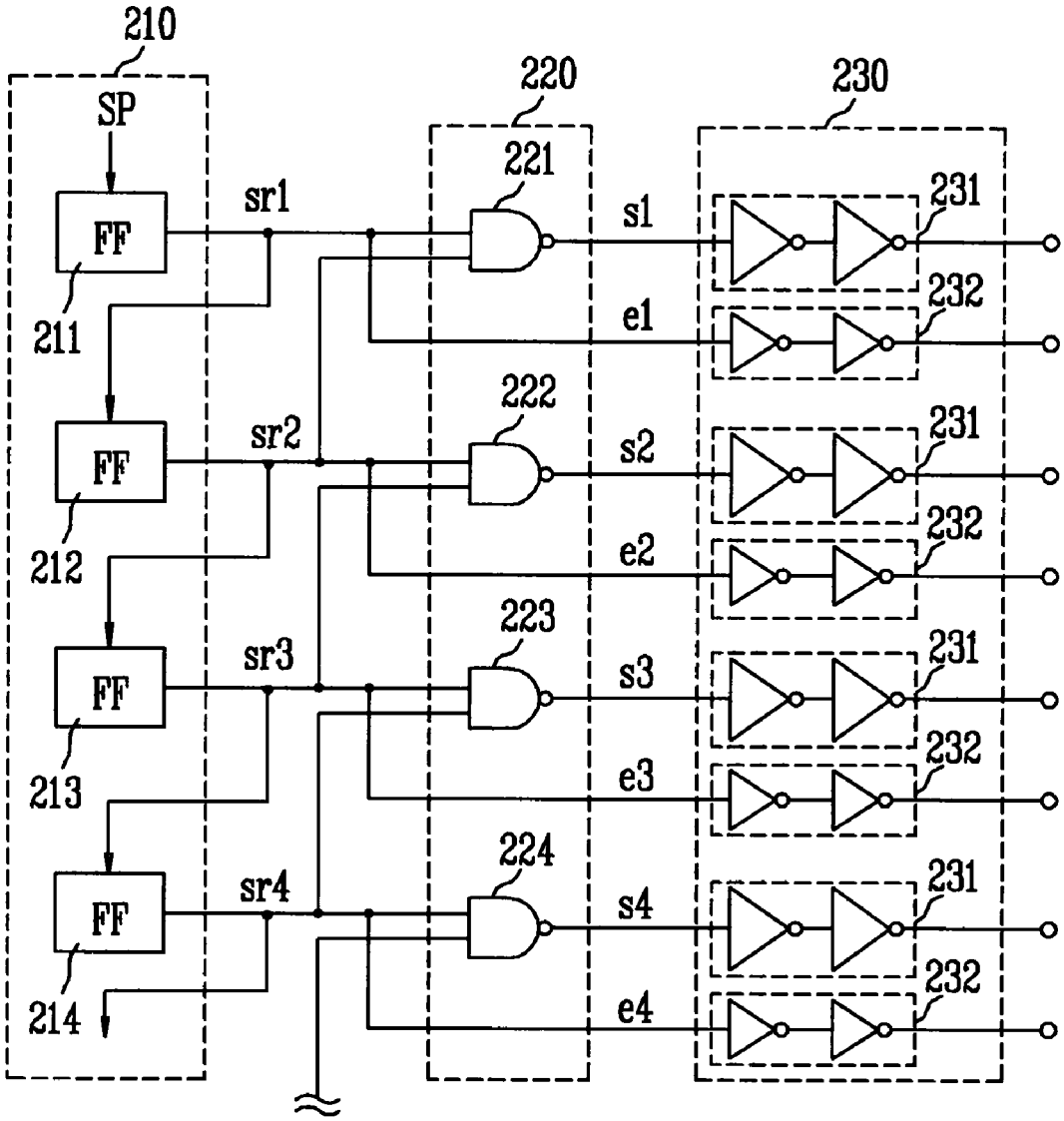
FIG. 6 is a control block diagram of the scan driver of FIG. 5 according to an embodiment of the present invention.
Figure 7:
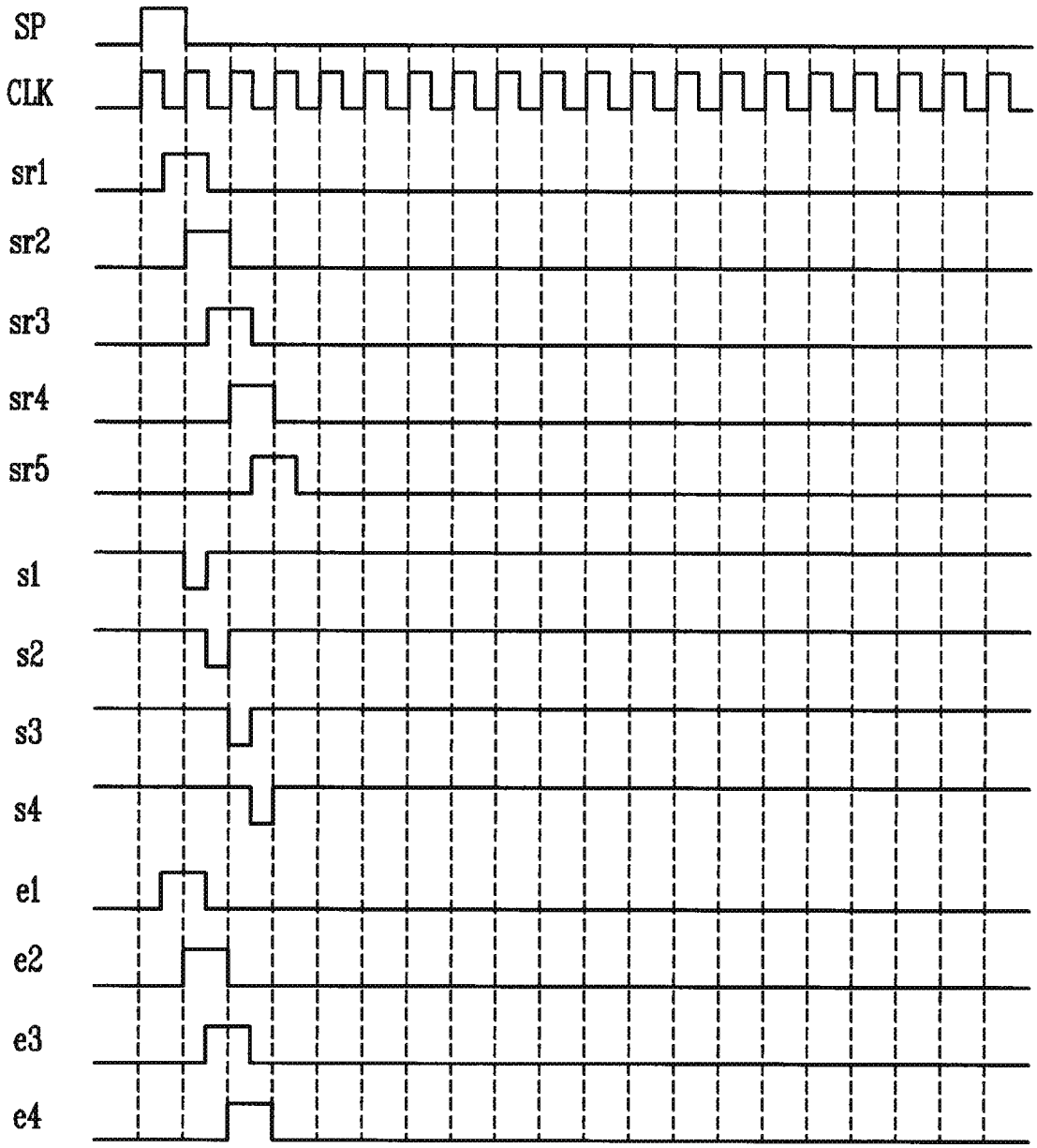
FIG. 7 is a view illustrating waveforms of signals of the scan driver of FIG. 6 according to an embodiment of the present invention.

FIG. 6 is a control block diagram of the scan driver of FIG. 5 according to an embodiment of the present invention, and FIG. 7 is a view illustrating waveforms of signals of the scan driver of FIG. 6 according to an embodiment of the present invention. Referring to FIGS. 6 and 7, the scan driver 200 includes the shift register 210 in which flip-flop circuitries are connected in a column; the operator 220 for receiving signals outputted from the shift register 210 and for outputting scan signals and emission control signals; and the buffer unit 230 including the first buffers 231 and the second buffers 232 adapted to increase the intensity of the scan signals and the emission control signals. Here, the first buffers 231 are respectively connected to the scan lines (or odd-numbered lines of the scan driver 200), and the second buffers 232 are respectively connected to the emission control lines (or even-numbered lines of the scan driver 200).

In the shift register 210, a higher (or top) flip-flop circuitry outputs a signal to a lower (or bottom) flip-flop circuitry, and the lower flip-flop circuitry shifts and outputs the signal received from the higher flip-flop circuitry.

For example, the shift register 210 includes a first flip-flop circuitry 211, a second flip-flop circuitry 212, a third flip-flop circuitry 213, and a fourth flip-flop circuitry 214 that are formed in sequence from a top of the shift register 210 to a bottom of the shift register 210.

The first flip-flop circuitry 211 receives a start pulse SP and outputs a first output signal sr1 when a clock waveform of the start pulse SP begins to fall. Then, the second flip-flop circuitry 212 receives the first output signal sr1 from the first flip-flop circuitry 211 and outputs a second output signal sr2 when a clock waveform of the first output signal sr1 begins to fall. Then, the third flip-flop circuitry 213 receives the second output signal sr2 from the second flip-flop circuitry 212 and outputs a third output signal sr3 when a clock waveform of the second output signal sr2 begins to fall. Then, the fourth flip-flop circuitry 214 receives the third output signal sr3 from the third flip-flop circuitry 213 and outputs a fourth output signal sr4 when a clock waveform of the third output signal sr3 begins to fall. Then, a following flip-flop circuitry (not shown) receives the fourth output signal sr4 from the fourth flip-flop circuitry 214 and outputs a fifth output signal (not shown) when a clock waveform of the fourth output signal sr4 begins to fall.

Thus, the first flip-flop 211 receives the start pulse SP and shifts it rightward by one clock waveform, thereby outputting the first output signal sr1. Further, the second flip-flop 212 receives the first output signal sr1 and shifts it rightward by one clock waveform, thereby outputting the second output signal sr2. Further, the third flip-flop 213 receives the second output signal sr2 and shifts it rightward by one clock waveform, thereby outputting the third output signal sr3. Further, the fourth flip-flop 214 receives the third output signal sr3 and shifts it rightward by one clock waveform, thereby outputting the fourth output signal sr4. Further, the following flip-flop (not shown) receives the fourth output signal sr4 and shifts it rightward by one clock waveform, thereby outputting the fifth output signal sr5 (not shown).

Further, the first output signal sr1 and the second output signal sr2 are respectively inputted into two input terminals of a first NAND gate 221, thereby creating the first scan signal s1. Further, the second output signal sr2 and the third output signal sr3 are respectively inputted into two input terminals of a second NAND gate 222, thereby creating the second scan signal s2. Further, the third output signal sr3 and the fourth output signal sr4 are respectively inputted into two input terminals of a third NAND gate 223, thereby creating the third scan signal s3. Further, the fourth output signal sr4 and the fifth output signal sr5 (not shown) are respectively inputted two input terminals of the fourth NAND gate 224, thereby creating the fourth scan signal s4.

Also, the first through fourth output signals sr1, sr2, sr3 and sr4 are outputted through separate terminals without passing through the respective NAND gates 221, 222, 223 and 224, thereby creating first through fourth emission control signals e1, e2, e3 and e4.

According to an embodiment of the present invention, the first through fourth scan signals s1, s2, s3 and s4 are each inputted to a corresponding one of the first buffers 231, and the first through fourth emission control signals e1, e2, e3 and e4 are each inputted to a corresponding one of the second buffers 232.

Each of the first and second buffers 231 and 232 includes two inverters connected in series. Here, each of the second buffers 232 is connected to a corresponding one of the emission control lines, and each of the first buffers 231 is connected to a corresponding one of the scan lines, so that the size of each of the second buffers 232 can be smaller than each of the first buffers 231.

As described above, the present invention provides a light emitting display and a scan driver, in which the size of a buffer connected to an emission control line is smaller than that of another buffer connected to a scan line, so that the size of the buffer occupying the scan driver is reduced, thereby decreasing the size of the scan driver and reducing power consumption in the scan driver.

Further, the present invention provides a light emitting display and a scan driver, in which the size of a buffer is decreased, so that an interval distance between a scan line and an emission control line (and/or between two scan lines or two emission lines) is decreased, thereby decreasing the size of a pixel.

In view of the foregoing a light emitting display according to an embodiment of the present invention is suitable for a large-sized screen and having a high-definition.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A light emitting display comprising a pixel area having a plurality of pixels, a scan driver for outputting a scan signal for selecting a predetermined pixel among the plurality of pixels of the pixel area, and an emission control signal for controlling a current to flow in the predetermined pixel, the scan driver comprising:

a signal generator adapted to generate the scan signal and the emission control signal;

a first buffer adapted to transmit the scan signal to the pixel area; and a second buffer adapted to transmit the emission control signal to the pixel area, wherein the second buffer has a first size and the first buffer has a second size, wherein the first size is smaller than the second size, and wherein the first buffer and the second buffer have different response times.

2. The light emitting display according to claim 1, wherein the first buffer has a first response time and the second buffer has a second response time, and wherein the first response time is faster than the second response time.

3. The light emitting display according to claim 1, wherein the predetermined pixel comprises:

a light emitting device adapted to emit light corresponding to a data signal;

a first switching device being turned on by the scan signal to transmit the data signal;

a capacitor being charged with an electric charge corresponding to the data signal;

a driving transistor adapted to output a driving current corresponding to the electric charge charged in the capacitor; and a second switching device being turned on by the emission control signal to output the driving current to the light emitting device.

4. The light emitting display according to claim 1, wherein each of the first and second buffers comprises at least two inverters connected in series.

5. The light emitting display according to claim 1, further comprising a data driver adapted to generate a data signal to the pixel area.

6. The light emitting display according to claim 1, wherein the signal generator comprises a shift register adapted to shift an input signal and output the shifted signal to a plurality of output terminals, and an operator adapted to perform an operation on the plurality of signals outputted from the shift register through the plurality of output terminals and output the scan signal and the emission control signal.

7. A light emitting display comprising:

a pixel area comprising a plurality of pixels;

a scan driver comprising a signal generator adapted to generate a scan signal and an emission control signal, a first buffer adapted to transmit the scan signal to the pixel area, and a second buffer adapted to transmit the emission control signal to the pixel area; and a data driver adapted to generate a data signal to the pixel area, wherein the first buffer has a first response time and the second buffer has a second response time, and wherein the first response time is faster than the second response time.

8. The light emitting display according to claim 7, wherein the second buffer has a first size and the first buffer has a second size, and wherein the first size is smaller than the second size.

9. The light emitting display according to claim 7, wherein at least one of the pixels comprises:

a first switching device being turned on by the scan signal to transmit the data signal;

a capacitor being charged with an electric charge corresponding to the data signal;

a driving transistor adapted to output a driving current corresponding to the electric charge charged in the capacitor; and a second switching device being turned on by the emission control signal to transmit the driving current to the light emitting device.

10. The light emitting display according to claim 7, wherein each of the first and second buffers comprises at least two inverters connected in series.

11. The light emitting display according to claim 7, wherein the signal generator comprises a shift register adapted to shift an input signal and output the shifted signal to a plurality of terminals, and an operator adapted to perform an operation on the plurality of signals outputted from the shift register through the plurality of terminals and output the scan signal and the emission control signal.

12. A scan driver comprising:

a signal generator comprising a shift register adapted to shift an input signal and output the shifted signal to a plurality of output terminals, and an operator adapted to perform an operation on the plurality of signals outputted from the shift register through the plurality of output terminals and output a scan signal for selecting a predetermined pixel and an emission control signal for allowing a current to flow in the predetermined pixel;

a first buffer adapted to transmit the scan signal to the predetermined pixel; and a second buffer adapted to transmit the emission control signal to the predetermined pixel, wherein the second buffer is smaller than the first buffer, and wherein the first buffer and the second buffer have different response times.

13. The scan driver according to claim 12, wherein the first buffer has a first response time and the second buffer has a second response time, and wherein the first response time is faster than the second response time.

14. The scan driver according to claim 12, wherein the predetermined pixel comprises:

a light emitting device adapted to emit light corresponding to the current flown in the predetermined pixel;

a first switching device being turned on by the scan signal to transmit a data signal;

a capacitor being charged with an electric charge corresponding to the data signal;

a driving transistor adapted to transmit a driving current corresponding to the electric charge charged in the capacitor; and a second switching device being turned on by the emission control signal to transmit the driving current to the light emitting device.

15. The scan driver according to claim 12, wherein each of the first and second buffers comprises at least two inverters connected in series.

* * * * *